US006361636B1

(12) United States Patent
Kast et al.

(10) Patent No.: US 6,361,636 B1
(45) Date of Patent: Mar. 26, 2002

(54) PROCESS TO MANUFACTURE A BACK-ADHERING MATERIAL FOR AN INNER BOOK

(75) Inventors: Christoph Kast; Thomas Fuchs, both of Sonthofen (DE)

(73) Assignee: Dr. Günther Kast GmbH & Co., Sonthofen (DE)

( * ) Notice: Subject to any disclaimer, the term of this patent is extended or adjusted under 35 U.S.C. 154(b) by 0 days.

(21) Appl. No.: 09/349,668

(22) Filed: Jul. 8, 1999

(30) Foreign Application Priority Data

Oct. 6, 1998 (DE) ..... 198 45 923

(51) Int. Cl.[7] ..... B31F 1/12; B31F 1/16

(52) U.S. Cl. ..... 156/183; 156/183; 156/196; 156/199; 8/117; 162/111; 162/280; 264/282; 281/36; 412/3

(58) Field of Search ..... 156/183, 196, 156/199; 264/282, 283; 281/36; 412/3, 4, 5; 8/117; 162/111, 280, 281, 282

(56) References Cited

U.S. PATENT DOCUMENTS 3,290,209 A * 12/1966 Ihrman ..... 264/282
3,632,297 A * 1/1972 Sello ..... 8/116.2
3,753,842 A * 8/1973 Pittman ..... 161/57
3,810,280 A * 5/1974 Walton et al. ..... 26/18.6
3,819,465 A * 6/1974 Parsons et al. ..... 161/74

* cited by examiner

*Primary Examiner*—Richard Crispino
*Assistant Examiner*—Cheryl N. Hawkins
(74) *Attorney, Agent, or Firm*—Notaro & Michalos P.C.

(57) ABSTRACT

In the manufacture of a hardcover book, a laminated sheet is fed to the inner book spine with a wide roll machine, and the sheet consists of a paper-laminated gauze. The laminate is subsequently treated and has a flat fine creping with a lengthwise elasticity of 5–15%. The end of the laminate sheet is fed to the inner book (12) perpendicular to the lengthwise direction of the inner book spine and pressed onto the glued inner book spine followed by the 10 mm overlaps to either side. The joint material (36) that is applied is elastic perpendicular to the inner book spine. The inner book can then be trimmed and rounded, and the joint (36) stretches without losing stability or tearing.

2 Claims, 5 Drawing Sheets

PROCESS TO MANUFACTURE A BACK-ADHERING MATERIAL FOR AN INNER BOOK

FIELD AND BACKGROUND OF THE INVENTION

The invention concerns a process to manufacture a back-adhering material for an inner book of a hard cover book whereby a sheet of cotton fabric is pretreated by being washed, desized, bleached and dried, and then laminated with a paper sheet with an adhesive, and the resulting laminate is calendered to smooth and harden it.

The created laminate is glued to the inner book on the spine from narrow rolls parallel to the inner book. The gauze acts like a hinge for the inner book. In efficient book manufacturing, the laminate is applied to the inner book spine before the inner book is rounded, and the laminate is stretched while rounding the inner book spine. The laminate must permit this stretching without tearing. The laminate is sufficiently elastic in the direction of the weft thread, i.e., perpendicular to the lengthwise direction of the sheet, but not in the direction of the warp thread. The laminate can only be used in narrow rolls whose width corresponds to the width of the inner book plus 2×10 mm of side overlap.

In hardcover production using perfect binders, wide rolls are used where the width of the wide roll consists of the untrimmed inner book height plus at least 2×5 mm overlap for both sides. Prior art hinge material from wide rolls is not sufficiently elastic in a lengthwise direction because the warp thread of the fabric is not sufficiently elastic. At present, wide-roll machines (perfect binders) can only use a crepe paper that consists of a base paper of 70–90 g that is sufficiently elastic in the lengthwise direction to allow the inner book spine to be rounded. The stability of the inner book spine consisting only of crepe paper is limited after the inner book has been rounded and hardened. This is particularly problematic for thicker books.

To compensate at least slightly for the poor quality of hardcovers made with perfect binders, a somewhat involved process is pursued. After the crepe paper is applied to the inner block and trimmed, and the inner book spine is rounded in the book processing line, an additional work station is included in the process in which gauze is applied to the crepe paper. Apart from the additional machine expense, the gauze is shorter than the length of the trimmed inner book. The gauze hence does not provide a 100% bond between the inner book spine and the book cover. Tears can arise at the overlaps at the top and bottom of the spine. Of course, the gauze strips applied after rounding the inner book do not require and do not have any elasticity perpendicular to their length.

SUMMARY OF THE INVENTION

The problem of the invention is hence to create a process that allows a hardcover book to be produced on wide-roll machines (perfect binders) with more stable back-adhering material, especially elastic, laminated gauze.

This problem is solved by a process according to patent claim 1.

Thanks to the fact that the still-moist laminated sheet of material gathers or shrinks in a lengthwise direction before it dries, the sheet of material is given a flat, fine creping that is elastic in the warp direction. This elasticity can be set between 5% to approx. 15% and is sufficient for wide-roll machines to round thick inner books. The gauze coated with paper on one is a suitable starting material for the sheet of laminated material as is used successfully on narrow roll machines. The hinge material that is subsequently provided with the flat fine creping can hence be used for hardcover production on wide roll machines instead of the crepe paper that has been used by itself to date. This substantially increases the stability of the inner book spine.

Different processes can be used to crepe the material. It is easiest to crepe the laminate material with a doctor blade after the material is moistened. The doctor blade compresses the material somewhat. Then the sheet that is compressed in a lengthwise direction is dried and the creping becomes fixed. However, the creping from this procedure would then be too coarse with the danger of the fabric separating from the paper. Another type of creping can be attained in a machine with different roller speeds. Usually, however, the creping is not fine enough even with this procedure, and cross-wise waves arise in the sheet of material which makes the sheet limp and difficult to process in perfect binders.

In an development of the invention, the fine creping of the laminate is created by sanforizing in which the moist laminate material sheet is guided between a stretched, thick rubber belt and a drying cylinder and crimped. The drying cylinder dries the paper and the fabric and simultaneously fixes the residual shrinkage of the laminate. The attained fine creping produces a residual shrinkage of ca 10–15% in the final product.

In a final step, the laminate is preferably dried on a felt calender. This preferably consists of a steam-heated roller with a surface temperature of 100–160° C. around which runs a felt cloth. The laminated sheet is guided between the felt cloth and the steam-heated roller and dried. The laminate is then wound with as little tension as possible.

The laminate back-adhering material does not require any technical changes different from crepe paper in the book-binding machines that are used for further processing. The new laminate has improved running properties, and the jams that frequently arise in crepe paper are eliminated or at least reduced since the material from the wide roll is guided to the inner book via a suction feeder. Unavoidable fluctuations in crepe paper height cause the crepe to jam in the suction feeder when no air flows through the crepe. The hinge material according to the invention is contrastingly more even and flatter so that the process of bringing the laminate to the inner book by the blown air is improved. There are also no problems when cutting the laminate according to the invention in the perfect binder. A book binder who uses exclusively perfect binding can create the same high-quality hardcover books with an inner book thickness over 4 cm on wide roller machines with the laminate manufactured according to the invention. The laminate is applied to the inner book before trimming and rounding the inner book spine, and the material is stretched in the rounding station. The elasticity can be greater than is possible with narrow roll machines.

BRIEF DESCRIPTION OF THE DRAWINGS

The invention also concerns a book consisting of an inner book held a cover whose rounded back has a glued-on joint that consists of a paper-laminated cotton fabric. This new book is characterized in that the weft fibers of the cotton fabric in the joint run in the lengthwise direction of the inner book spine, and the joint has a flat fine creping.

The invention will be further explained with reference to the drawing that shows an exemplary embodiment.

Figure 1:
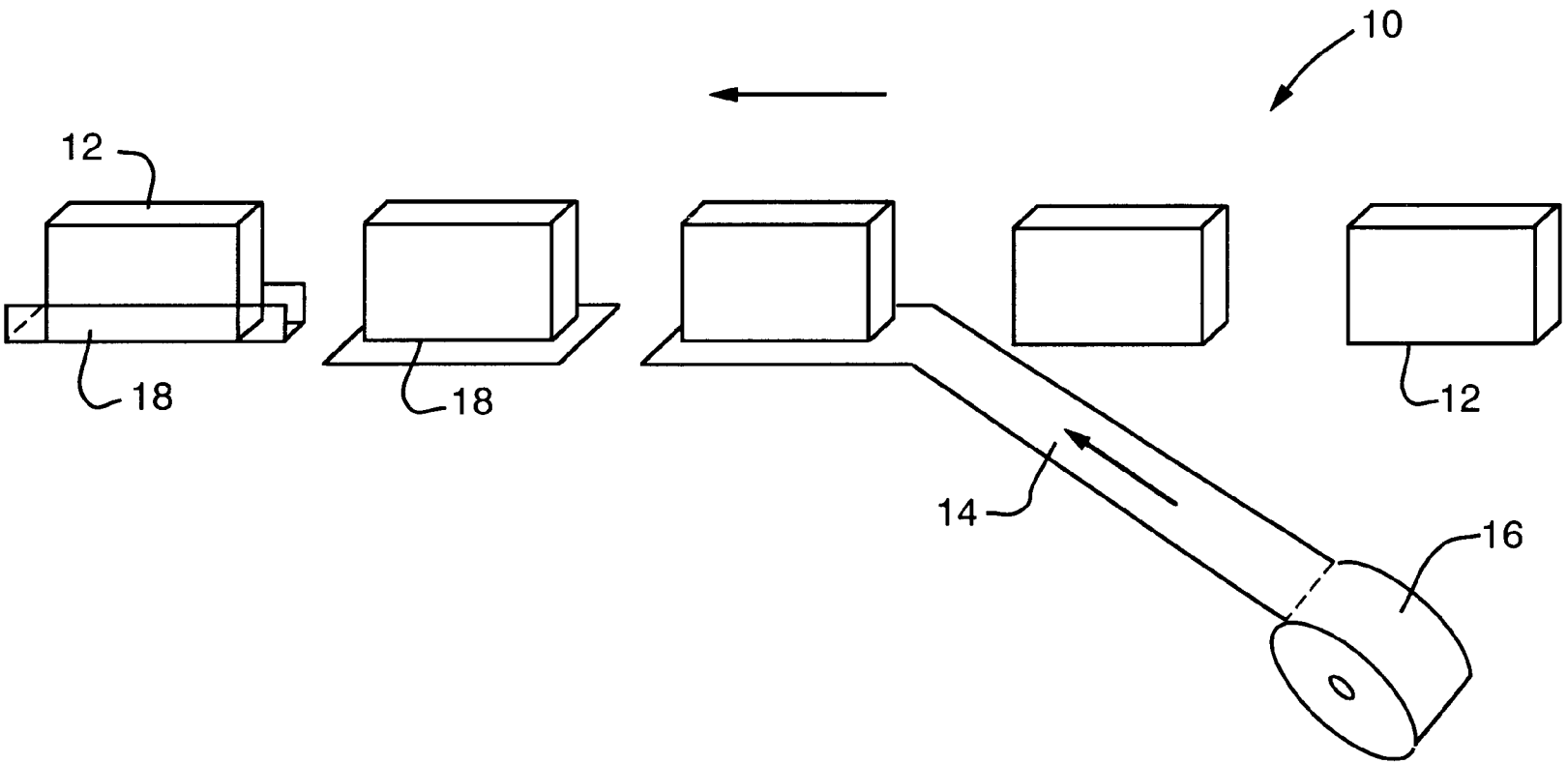
Figure 2:
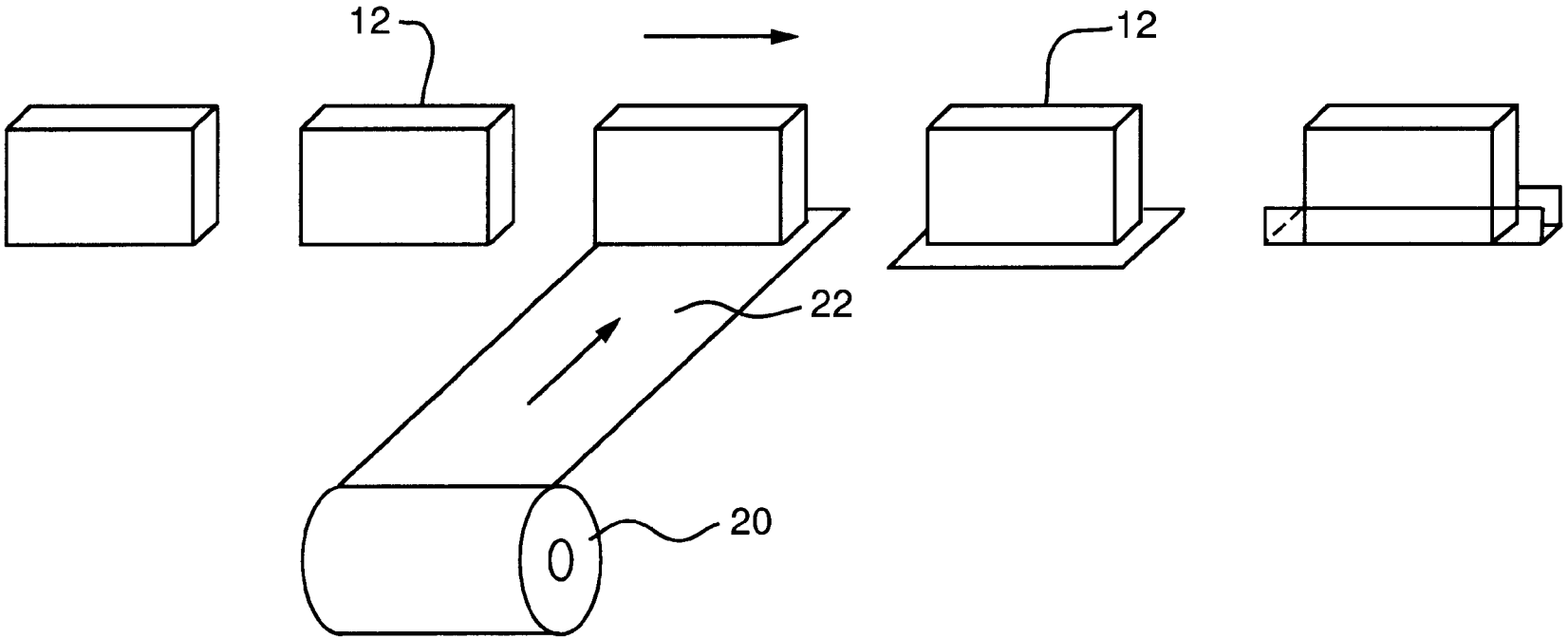
Figure 3:
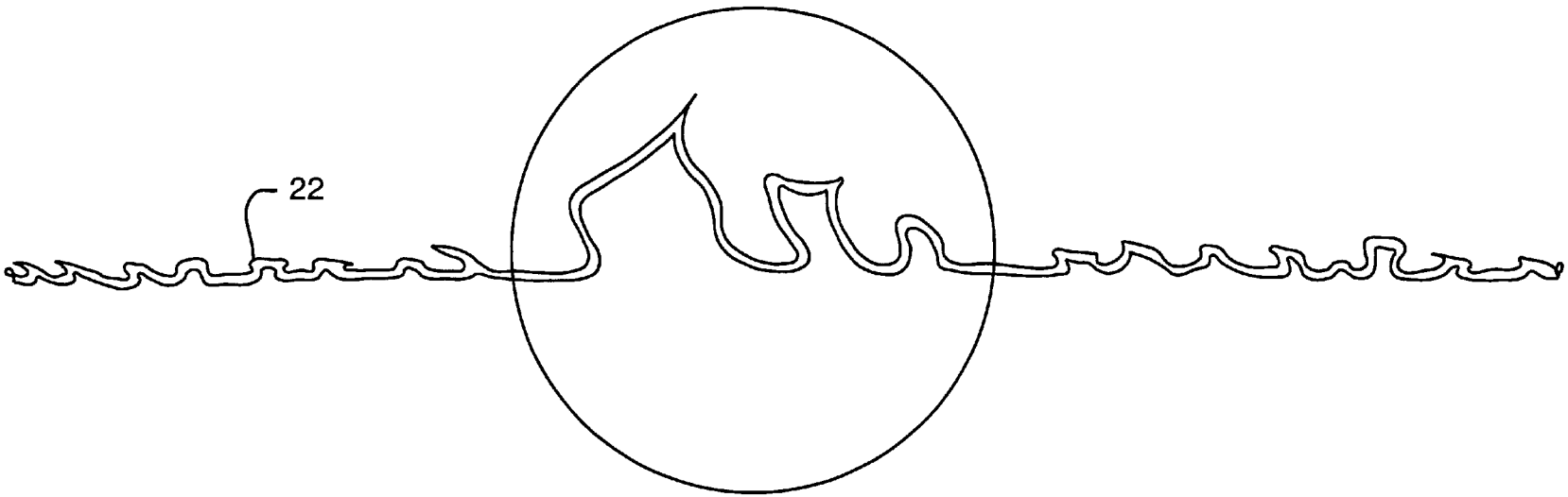
Figure 4:
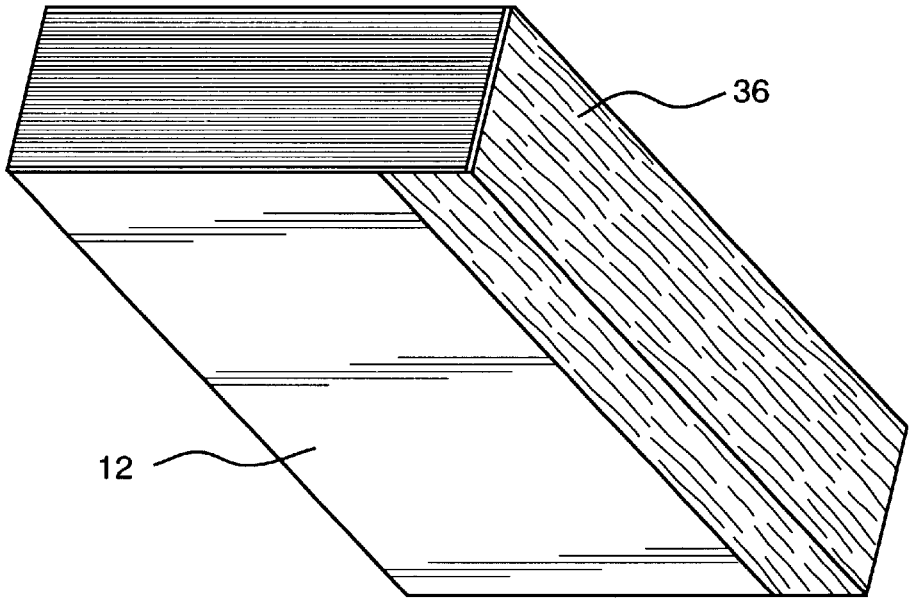
Figure 5:
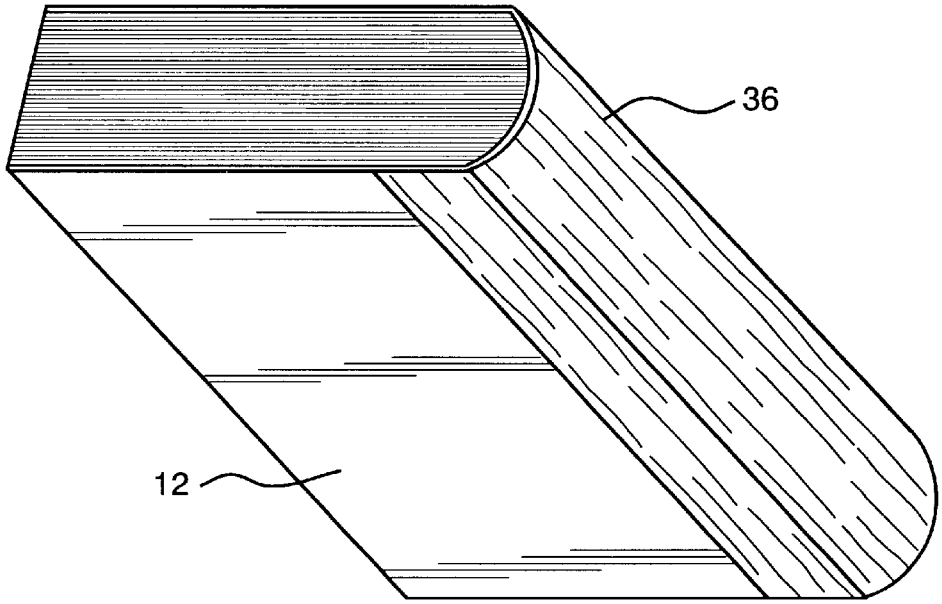
Figure 6:
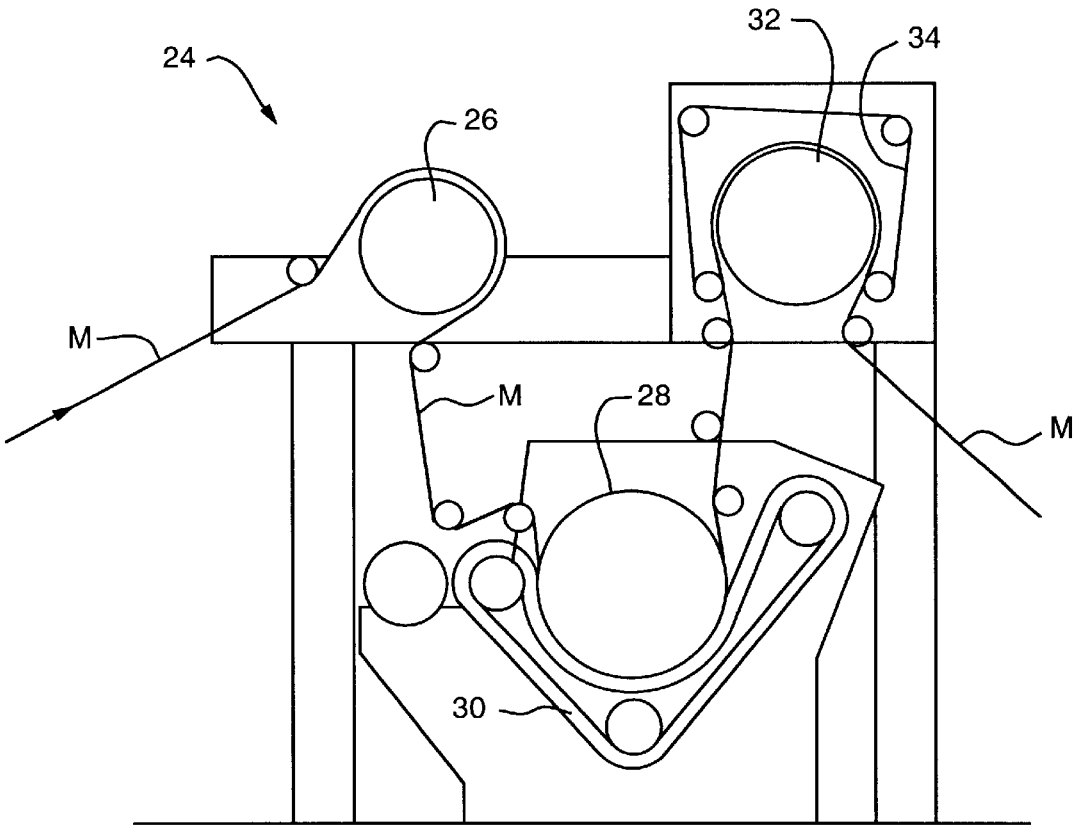

Shown are:

FIG. 1 A section of a book spine joint and side pasting device with narrow rolls of material, FIG. 2 A part of a perfect binder with wide roll material, FIG. 3 A greatly enlarged cross-section of a back-adhering material for the inner book spine in the process in FIG. 2, FIG. 4 A three-dimensional view of an inner book with the strips of back adhering material on the sides corresponding to FIG. 3, FIG. 5 The inner book from FIG. 4 after the inner book spine has been rounded, and FIG. 6 A schematic view of a system to crimp the laminate for the inner book back.

DESCRIPTION OF THE PREFERRED EMBODIMENT

In FIG. 1, the spine of an untrimmed inner book 12 is glued in a joint and side pasting device 10, and a laminate 14 consisting of gauze with a paper layer is placed on the glued spine of the inner book as a joint strip. The laminate 14 runs from a narrow roll 16 and is applied in the lengthwise direction of the inner book spine. The width of the sheet equals the spine plus 2×10 mm overlap for both sides. After the laminate is adhered to the spine and the front and back sides are glued, the joint material between the inner books is cut. Then the inner book is trimmed and rounded, and the back adhering material 18 is stretched perpendicular to the length. This is possible because the fabric of the laminate sheet 14 is sufficiently elastic in the direction of the weft.

The wide roll process sketched in FIG. 2 is used in perfect binders. The back-adhering material is removed from a wide roll 20, and its width is the same as the uncut inner book height plus at least 2×5 mm overhang. The laminate of the narrow roll 16 in FIG. 1 cannot be used for the wide roll 20 because lengthwise elasticity of the laminate sheet is necessary to allow the inner book spine to the rounded later. The laminate sheet 22 in FIG. 2 can be used as a starting material that corresponds to that of the narrow roll 16 in FIG. 1, however it requires subsequent treatment to attain the lengthwise elasticity of material sheet 22. This starting material consists of gauze that is laminated with a paper sheet. The gauze consists of cotton calico with 18 threads in the warp and 10 in the weft. The thread thickness in 60/60 and 60/70 Nm. The cotton calico must be pretreated before being processed further to improve the running properties in the book binding machine. This means that the raw fabric is washed, desized and bleached. This process gives the fabric a certain absorbability. After the fabric is dried, it is laminated with a mixture of starch and plastic dispersions to a ca 25 g weight paper. The paper lamination prevents the glue in the book binding process from pressing through to the rear of the back-adhering material. To smooth the surface and strengthen the bond between the fabric and paper, the back adhering material is calendered which corresponds to a strong pressing and ironing process. The laminate created in this manner is sanforized. Such a system is shown in FIG. 6.

The sheet of material M is first guided around a perforated cylinder 26 where it is heated with steam. This steam treatment makes the material soft, deformable and flexible. The material sheet M is introduced into a gap between a steel cylinder 28 and a thick rubber belt and pressed. The fabric side of the material sheet M runs over the steel cylinder. The thickness of the rubber belt is 67 mm. At the inlet, the rubber belt 30 is pressed strongly. At the exit, the rubber belt 30 stretched ca 12%. The steel cylinder 28 is a highly-polished shrink roller that is chromed for corrosion protection. The cylinder 28 is steam heated to 100–130° C. The material sheet M is guided between the rubber belt 30 and the cylinder 28 where the actual crimping process occurs. The material sheet M is dried crimped by the steel cylinder 28, and the laminate is prefixed. Then the material sheet M is finally dried on a felt calender 32. The felt calender 32 is a steam-heated roller with a surface temperature of 100–160° C. The roller is covered with a felt strip 34. The material sheet M is guided between the felt strip and heated roller. The felt strip 34 serves to guide the material in a stable manner and prevents the crimping in the material sheet M from releasing. The material sheet M is wound with as little tension as possible. The wide rolls 20 in FIG. 2 are obtained from cutting the laminate roll obtained in this manner.

FIG. 3 shows a greatly enlarged lengthwise section of the crimped laminate 22. The circled part of FIG. 3 shows a further enlargement. The laminate can be described as coarse or wavy, and the wave height is not much more than the thickness of the laminate 22. The laminate 22 in a lengthwise direction has the form of a flat fine creping with a lengthwise elasticity of 10–15%. The flat creping of the laminate 22 ensures that the laminate runs will in the perfect binder. In FIG. 2, the material thickness of the laminate 22 in the circled part is not to scale in relation to the creping height.

The laminate sheet 22 drawn from the wide roll 20 in FIG. 2 is cut to the inner book thickness +2×10 mm and applied to the glued inner book to produce a straight inner book as shown in FIG. 4. The joint 36 on the inner book spine has a flat fine creping. In the later rounding process, the inner book spine is rounded, and the spine 36 is stretched given its elasticity from being treated in the sanforizing system. This is indicated by the fold lines in FIG. 5 that are further apart than those in FIG. 4.

What is claimed is:

1. A process for creating a back-adhering material for an inner book (12) of a hardcover book in which a cotton fabric sheet is pre-treated by being washed, desized, bleached and dried and then laminated with a paper sheet using an adhesive to form a laminate sheet (22) which is calendered to smooth it and harden it, the process comprising: moistening the laminate sheet to form a moist laminate sheet; shrinking the laminate sheet in a length wise direction by a sanforizing process; finely crimping the moist laminate sheet in a lengthwise direction to obtain fine creping; and fixing the attained fine creping by drying the laminate sheet (22).

2. A process for creating a back-adhering material for an inner book (12) of a hardcover book in which a cotton fabric sheet is pre-treated by being washed, desized, bleached and dried and then laminated with a paper sheet using an adhesive to form a laminate sheet (22) which is calendered to smooth it and harden it, the process comprising: moistening the laminate sheet to form a moist laminate sheet; finely crimping the moist laminate sheet (22) in a lengthwise direction to obtain fine creping, the crimping being achieved by pressing the moist laminate sheet between a stretched rubber belt (30) and a drying cylinder (28) and then compressing the laminate sheet in the form of a flat creping by releasing the rubber belt (30); and fixing the attained fine creping by drying the laminate sheet (22).

* * * * *